United States Patent [19]

Shaw

[11] Patent Number: 4,747,086

[45] Date of Patent: May 24, 1988

[54] DIGITAL WATCH WITH FLUORESCENT DISPLAY AND MERCURY COATED CRYSTAL

[76] Inventor: Borliam Shaw, 704 Lookout Dr. #1, Los Angeles, Calif. 90012

[21] Appl. No.: 89,167

[22] Filed: Aug. 25, 1987

[51] Int. Cl.[4] ..... G04C 17/00

[52] U.S. Cl. ..... 368/239; 368/241; 368/82; 368/83

[58] Field of Search ..... 368/227, 67, 84, 239, 368/241

[56] References Cited

U.S. PATENT DOCUMENTS 4,202,607 5/1980 Washizuka et al. ..... 368/10
4,271,492 6/1981 Battista ..... 368/67

FOREIGN PATENT DOCUMENTS 179683 9/1985 Japan ..... 368/227

*Primary Examiner*—Bernard Roskoski
*Attorney, Agent, or Firm*—Jerry T. Kearns

[57] ABSTRACT

A digital watch has a fluorescent display which is selectively actuated by depressing a button which extends through the watch casing. The watch crystal is formed from a scratch resistant mineral glass, and has a thin film mercury coating on the inner surface. The mercury coating may be sandwiched between the watch crystal and a thin transparent plastic film. When the fluorescent display is activated the display may be seen by the outside world through the watch crystal. However, when the fluorescent display is inactivated, the watch crystal appears as a mirror to the outside world. In a second embodiment of the invention, a tinted watch crystal is utilized in conjunction with a fluorescent display.

4 Claims, 2 Drawing Sheets

DIGITAL WATCH WITH FLUORESCENT DISPLAY AND MERCURY COATED CRYSTAL

BACKGROUND OF THE INVENTION

1. Field of the Invention

The present invention relates to digital watches, and more particularly pertains to a new and improved digital watch crystal which serves as a mirror. A fluorescent display may also be utilized in conjunction with a tinted watch crystal. Various types of displays are utilized in conventional digital watches. Liquid crystal displays and LED displays are widely utilized. Liquid crystal displays have the advantage of an extremely low power consumption, allowing them to be visible at all times. However, these liquid crystal type displays are not visible in a darkened room. LED type displays have the advantage of easy visibility in dark rooms, but because of their high power consumption, the wearer must activate the display by pushing a button on the side of the watch casing. LED displays are also difficult to read in bright sunlight. Both of the liquid crystal and LED type displays are disadvantageous in that they provide a relatively unattractive watch face. Some watch manufacturers have even gone to the length of providing both liquid crystal and LED displays on a single watch. Despite the more accurate nature of digital watches, conventional analog watches retain a large market share, due to their more attractive appearance. The present invention addresses these problems by providing a digital watch display which is easily read in any light, and also presents an attractive watch face.

2. Description of the Prior Art

Various types of digital watches are known in the prior art. A typical example of such a digital watch is to be found in U.S. Pat. No. 3,871,170, which issued to J. Bergey on Mar. 18, 1975. This patent discloses a solid state digital wristwatch with an electro-optical digital display of the LED type. Incorporated in the watch is a switch for actuating the display in response to a predetermined movement of the wearer's arm. U.S. Pat. No. 3,971,206, which issued to R. Martino on July 27, 1976, discloses digital watch and watchband arrangement in which the watch batteries are located in the watchband, separate from the watch movement and display. U.S. Pat. No. 3,984,973, which issued to E. Ho on Oct. 12, 1976, discloses digital watch with a dual display. A liquid crystal display for use in daylight or bright light, and a LED display for use in dim light, are provided. U.S. Pat. No. 4,086,754, which issued to M. Yonekawa et al on May 2, 1978, discloses digital watch which utilizes a LED display. An ornamental coating is provided over the rear surface of a front glass sheet except in the viewing region thereof. The coating may be provided through the use of painting, printing and vacuum deposition. A color filter corresponding to the color of the LED display is provided at least over the viewing window region. This arrangement is an attempt to provide an ornamented watch face display. U.S. Pat. No. 4,255,806, which issued to K. Fahrenschon et al on Mar. 10, 1981, discloses display for a digital watch which has a plurality of segment electrodes extending radially about a center point. This digital display may be operated through a multiplex arrangement to simulate the display of a conventional analog watch.

While the above mentioned devices are suited for their intended usage, none of these devices provide a digital watch crystal which forms a mirror. Further, none of the above patents disclose the use of a fluorescent display in conjunction with a tinted watch crystal. Additionally, none of the above patents disclose a watch crystal having a mercury coating on an inner surface. None of the prior art digital watches described above disclose a digital watch with an attractive display face. Inasmuch as the art is relatively crowded with respect to these various types of digital watches, it can be appreciated that there is a continuing need for and interest in improvements to such digital watches, and in this respect, the present invention addresses this need and interest.

SUMMARY OF THE INVENTION

In view of the foregoing disadvantages inherent in the known types of digital watches now present in the prior art, the present invention provides an improved digital watch. As such, the general purpose of the present invention, which will be described subsequently in greater detail, is to provide a new and improved digital watch which has all the advantages of the prior art digital watches and none of the disadvantages.

To attain this, representative embodiments of the concepts of the present invention are illustrated in the drawings and make use of a scratch resistant mineral glass crystal provided with a thin coating of mercury on an inner surface thereof. The present invention further utilizes a fluorescent display in conjunction with this mercury coated crystal. The use of a tinted watch crystal in conjunction with a fluorescent display is also contemplated by the present invention. The present invention seeks to provide a watch crystal which may also be utilized as a mirror.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved digital watch which has all the advantages of the prior art digital watches and none of the disadvantages.

It is another object of the present invention to provide a new and improved digital watch which may be easily and efficiently manufactured and marketed.

It is a further object of the present invention to provide a new and improved digital watch which is of a durable and reliable construction.

An even further object of the present invention is to provide a new and improved digital watch which is susceptible of a low cost of manufacture with regard to both materials and labor, and which accordingly is then susceptible of low prices of sale to the consuming public, thereby making such digital watches economically available to the buying public.

Still yet another object of the present invention is to provide a new and improved digital watch which provides in the apparatuses and methods of the prior art some of the advantages thereof, while simultaneously overcoming some of the disadvantages normally associated therewith.

Still another object of the present invention is to provide a new and improved digital watch which has a watch crystal which selectively provides a mirrored surface and a time display.

Yet another object of the present invention is to provide a new and improved digital watch which utilizes a tinted crystal in conjunction with a fluorescent display.

Even still another object of the present invention is to provide a new and improved digital watch having an attractive display surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
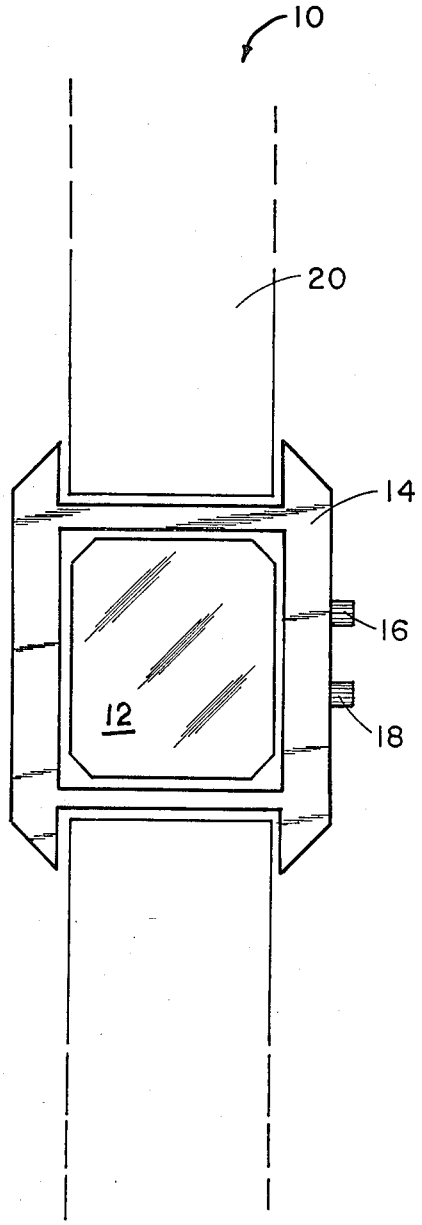
FIG. 1 is a top plan view of a digital watch of the present invention with the watch crystal presenting a mirror surface.

With reference now to the drawings, and in particular to FIG. 1 thereof, a new and improved digital watch embodying the principles and concepts of the present invention and generally designated by the reference numeral 10 will be described.

More specifically, it will be noted that the first embodiment 10 of the invention includes a watch crystal 12 received in a watch case 14. Conventional display activation button 16 and set control button 18 extend through the case 14. A conventional strap 20 is connected to the watch case 14. With the display in an inactivated condition, the watch crystal 12 appears as a mirror.

Figure 2:
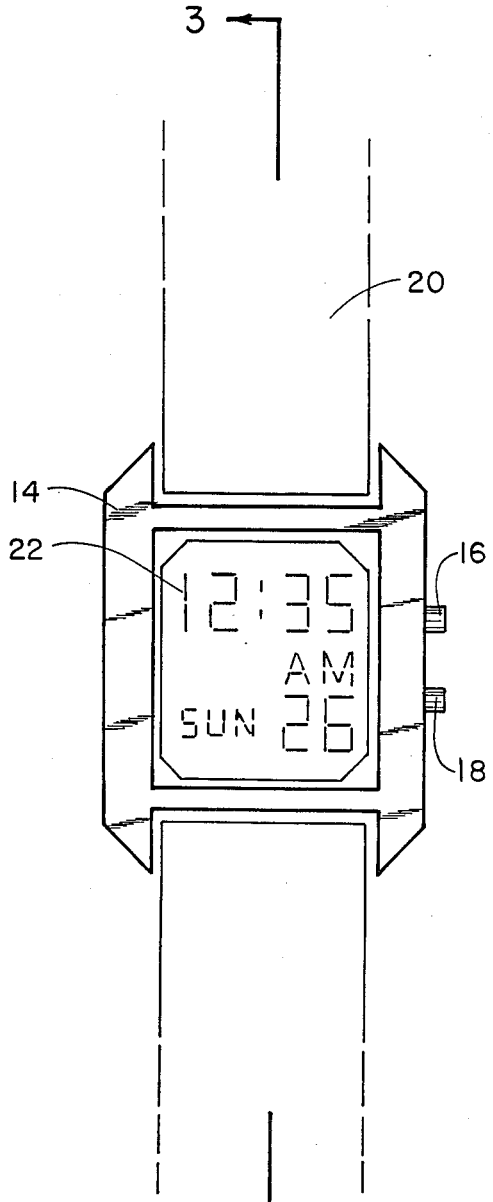
FIG. 2 is a top plan view of a digital watch of the present invention with the watch crystal providing a time display.

With reference now to FIG. 2, the appearance of the watch crystal 12 with the display activation button 16 depressed, is illustrated. A fluorescent time and date display 22 displays the current time and date.

Figure 3:
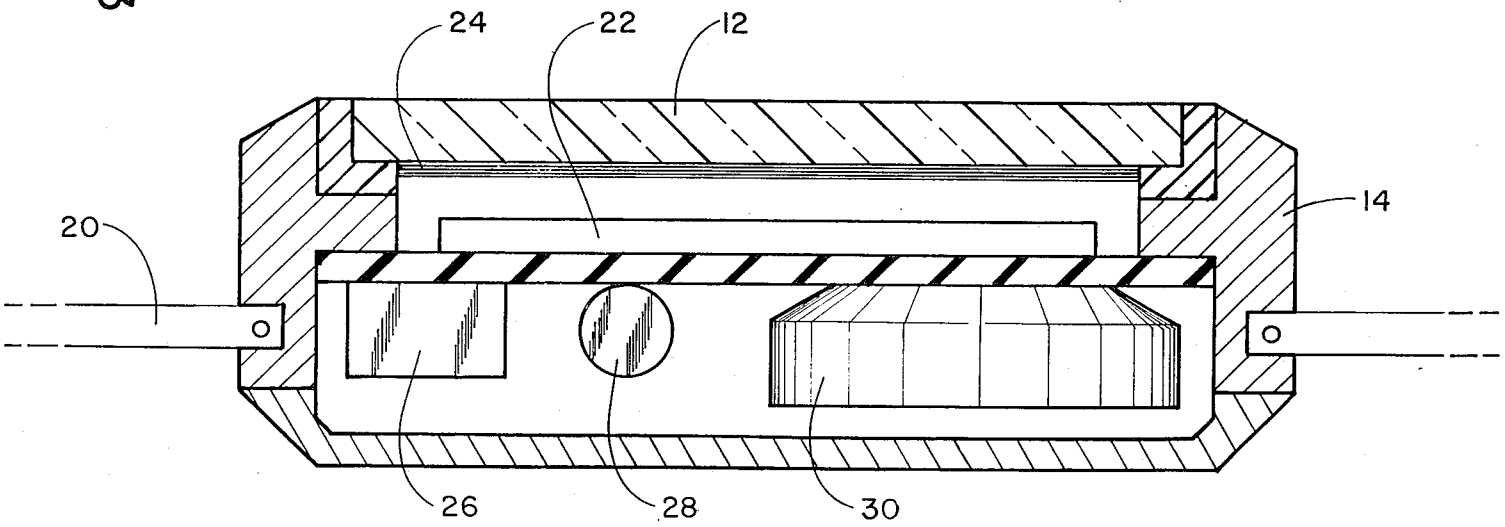
FIG. 3 is a cross sectional view taken along lines 3—3 of FIG. 2 and illustrating the interior of the watch casing.

With reference now to FIG. 3, a cross sectional view of the digital watch 10 of the present invention is provided. This view serves to illustrate the internal construction of the watch of the present invention. A thin film mercury coating 24 is provided on the inner face of the watch crystal 12. This coating may be provided by conventional techniques such as vapor deposition or by a mechanical coating application. The mercury coating 24 may be provided with a protective flexible transparent plastic film covering, thus sandwiching the mercury coating between the inner surface of the watch crystal 12 and the protective plastic film. The watch crystal 12 is preferably formed of a conventional scratch resistant mineral glass. Another feature of the present invention is the provision of a tint to the watch crystal 12. This may be accomplished by utilizing pigments in the formation of the watch crystal 12, or by providing a tinted film coating over the inner surface of the watch crystal 12. In both embodiments of the present invention, a conventional fluorescent display 22 is utilized. This display will selectively display the time and date when activated by depressing the external button 16. The fluorescent display 22 is conventional in construction and may be of the type utilized in video cassette recorders. Also contained within the watch casing 14 are conventional electronic watch components. For example, movement electronics 26, a crystal controlled oscillator 28, a battery 30 and a circuit board 32. The construction and arrangement of these components is conventional. For further details reference may be had to U.S. Pat. No. 3,672,155 and U.S. Pat. No. 4,086,754, the disclosures of both of which are hereby incorporated by reference.

With reference now to FIG. 1, the operation of the digital watch of the present invention will now be described. In a normal condition the fluorescent display is inactivated. Because there is no back light provided on the inner surface of the watch crystal 12, the mercury coating causes light striking the outer surface of the watch crystal 12 to be reflected, thus presenting a mirror surface to an observer. When the fluorescent display 22 is activated as shown in FIG. 2, by depressing button 16, a back light is provided through the mercury coating on the inner surface of the watch crystal 12. This causes the current time and date to be displayed to an observer through the outer surface of the watch crystal 12 as shown in FIG. 2.

According to a second embodiment of the present invention, the mercury coating on the inner surface of the watch crystal 12 may be omitted and a tint provided to the watch crystal 12 at a tinted film may be applied to the inner surface of the watch crystal 12. Then, when the fluorescent display 22 is actuated by depressing button 16, the fluorescent display will be apparent through a tinted surface. At other times, the tinted watch crystal will appear opaque to the observer.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. In a digital watch having a casing, electronic time keeping components disposed in said casing, a display for displaying the time and date and a glass crystal covering said display, the improvement comprising:

a coating of mercury on an inner surface of said glass crystal;

and said display comprising a fluorescent digital display.

2. The digital watch of claim 1, wherein said glass crystal comprises a tinted glass crystal.

3. The digital watch of claim 1, further comprising a thin plastic film over said mercury coating.

4. The digital watch of claim 1, further comprising a thin tinted plastic film bonded to an inner surface of said glass crystal.

* * * * *